US007002525B1

(12) United States Patent
Sergi

(10) Patent No.: US 7,002,525 B1
(45) Date of Patent: Feb. 21, 2006

(54) ANTENNA AND ITS METHOD OF ASSEMBLY

(76) Inventor: Paul D. Sergi, 2570 Major Rd., Peninsula, OH (US) 44264

( * ) Notice: Subject to any disclaimer, the term of this patent is extended or adjusted under 35 U.S.C. 154(b) by 5 days.

(21) Appl. No.: 10/774,654

(22) Filed: Feb. 9, 2004

(51) Int. Cl.
*H01Q 1/32* (2006.01)

(52) U.S. Cl. ..... 343/715; 343/713; 343/890

(58) Field of Classification Search ..... 343/711, 343/713, 715, 878, 890, 891
See application file for complete search history.

(56) References Cited

U.S. PATENT DOCUMENTS 2,445,336 A * 7/1948 Rauch ..... 343/890
4,149,169 A * 4/1979 Weber ..... 343/846
6,313,800 B1 * 11/2001 Kallina ..... 343/715
6,496,152 B1 * 12/2002 Nilsson ..... 343/713

* cited by examiner

*Primary Examiner*—Hoang V. Nguyen
(74) *Attorney, Agent, or Firm*—Renner, Kenner, Greive, Bobak, Taylor and Weber

(57) ABSTRACT

An antenna (10) includes a mast (12) which carries a coil (13) and a capacity hat (14). The capacity hat (14) includes a cylindrically shaped block (15) that is slidably received on the mast (12). The block includes a plurality of chordal bores (20–25) which are selectively adapted to receive conductive rods (40) therein. The configuration of the rods (40) is established by first identifying the desired frequency of operation for the antenna (10) and then selecting the size of the coil (13) and the configuration of the rods (40) which will provide approximately the desired frequency preferably using the smallest coil (13) possible to reduce losses.

29 Claims, 3 Drawing Sheets

ANTENNA AND ITS METHOD OF ASSEMBLY

TECHNICAL FIELD

This invention relates to a mobile, screwdriver or like antenna. More particularly, this invention relates to an antenna with an adjustable capacity hat permitting the use of a smaller coil for any given frequency.

BACKGROUND ART

Traditional high frequency (3.5–30 MHz) antennas, for example, of the mobile type, have an elongate whip or stinger carried at the top of a long mast, typically of about five feet in height. The whip itself may add another few feet to the height of the antenna. An antenna of such a height is often unsightly, if not unworkable, in mobile environments, and thus, it is desirable to provide shorter, more manageable antennas.

The problem is that when an antenna is shortened from its resonant length at the frequency of interest, the feedpoint becomes capacitive, and it becomes necessary to provide a loading coil to add the offsetting inductance. While such will restore the resonance of the antenna, the coil also has resistance which adds losses to the antenna, thereby draining power from the antenna. The more that one wishes to shorten the antenna, for mobile applications, the larger the coil that is required, thereby compounding the power loss problems.

One way to attempt to solve the problem and reduce the size of the coil is to install what is known as a capacity hat. Usually such a capacity hat can replace the whip or otherwise allow for the use of a much shorter whip. Thus, the capacity hat adds horizontal elements to the antenna to add effective length. Ideally, in a capacity hat, the currents in the horizontal sections will offset each other and preserve the vertical polarization of the wave radiated by the antenna. However, to date, there is no known capacity hat which is adjustable to accommodate a wide variety of coil sizes and desired frequencies.

DISCLOSURE OF THE INVENTION

It is thus an object of the present invention to provide an antenna which is designed to permit the use of a smaller coil for any given frequency.

It is another object of the present invention to provide an antenna, as above, which can operate at increased power without the need for an elongate whip.

It is an additional object of the present invention to provide an antenna, as above, with an adjustable capacity hat.

It is a further object of the present invention to provide a method of assembling an antenna so that it is tailored to precise operating frequencies.

These and other objects of the present invention, as well as the advantages thereof over existing prior art forms, which will become apparent from the description to follow, are accomplished by the improvements hereinafter described and claimed.

In general, an antenna made in accordance with the present invention includes a mast and a block carried by the mast. The block has a plurality of bores therein and conductive rods are slidably received in at least some of the bores.

Also in accordance with the present invention, there is a method of constructing an antenna having a mast which carries a coil and a plurality of rods. The method includes the steps of identifying a desired frequency of operation for the antennas, selecting the size of the coil and the configuration of the rods which will approximately provide the desired frequency, and then constructing the antenna with the selected coil and rod configuration.

In accordance with an additional aspect of the present invention, a method of constructing an antenna having a mast which carries a plurality of rods includes the step of selecting the number of rods and selecting the length of the rods. Then, the position of the rods relative to the mast is determined.

A preferred exemplary antenna according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
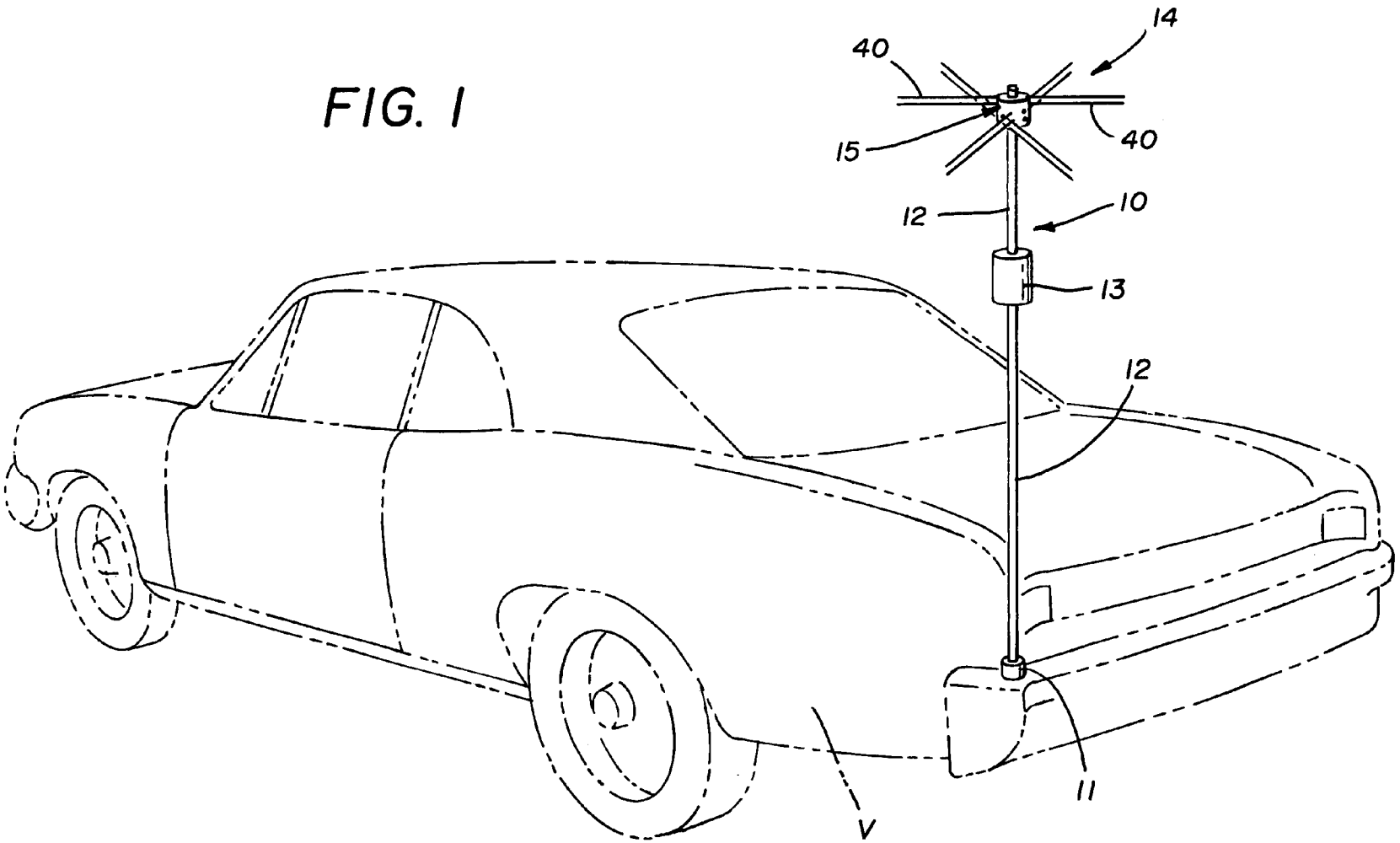
FIG. 1 is a somewhat schematic perspective view of an antenna made in accordance with the present invention shown as being mounted on a vehicle.
Figure 2:
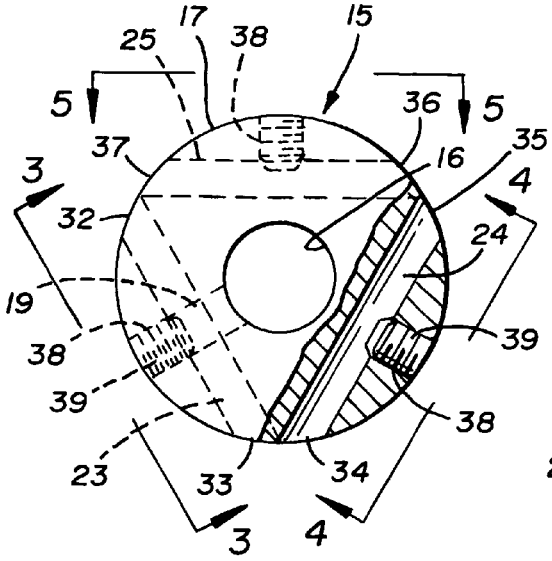
FIG. 2 is a partially broken away top view of a hub or mounting block which carries the antenna rods of the capacity hat of the antenna.
Figure 3:
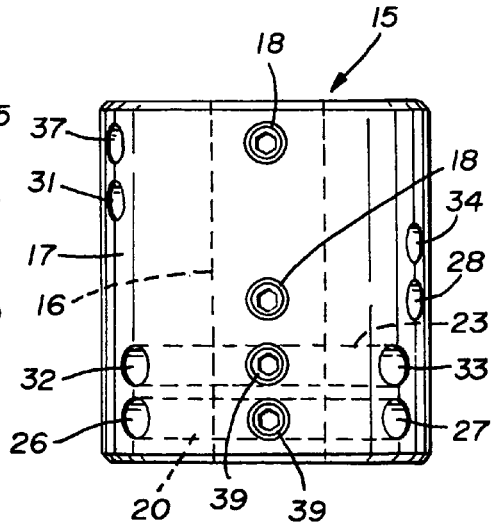
FIG. 3 is an elevational view taken substantially along line 3—3 of FIG. 2.
Figure 4:
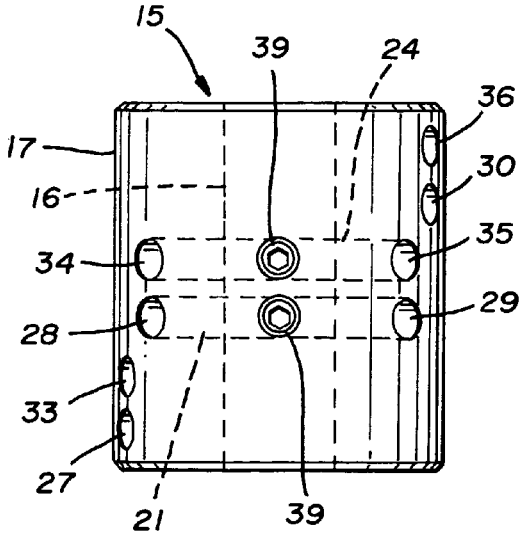
FIG. 4 is an elevational view taken substantially along line 4—4 of FIG. 2.
Figure 5:
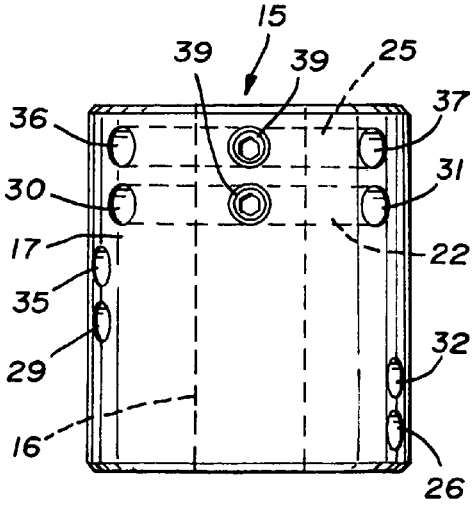
FIG. 5 is an elevational view taken substantially along line 5—5 of FIG. 2.

An antenna made in accordance with the present invention is somewhat schematically shown in FIG. 1 and is indicated generally by the numeral 10. Antenna 10 is shown as being a mobile antenna and is, therefore, attached, as at 11, to the bumper of a vehicle V. However, the present invention is applicable to antennas other than mobile antennas, such as screwdriver antennas and the like.

Antenna 10 includes a mast 12 extending upwardly from the vehicle V, a conventional coil 13 carried by the mast 12 at some intermediate point therealong, and a capacity hat generally indicated by the numeral 14 and carried at the top of mast 12.

A significant component of capacity hat 14 is a hub or mounting block generally indicated by the numeral 15 and adapted to attach the capacity hat 14 to mast 12. As can be seen in FIGS. 2–5, block 15 is a cylindrical item having an axial bore 16 formed centrally thereof and having a generally cylindrical outer surface 17. Block 15 can be selectively positioned at the desired height on mast 12. To that end, mast 12 is slidably received in central bore 16 and held in place by set screws 18 (FIG. 3) received in axially spaced radial passageways 19 (FIG. 2) which extend from outer surface 17 to axial bore 16.

Block 15 is also provided with a first set of chordal bores 20, 21 and 22, and a second set of chordal bores 23, 24 and 25 parallel to and axially spaced from bores 20, 21 and 22, respectively. Bore 20 thus extends from aperture 26 to aperture 27 in surface 17, which apertures are approximately 120 degrees of each other; bore 21 extends from aperture 28 to aperture 29 in surface 17, which are approximately 120 degrees of each other; and bore 22 extends from aperture 30 to aperture 31 in surface 17, which are approximately 120 degrees of each other. Similarly, bore 23 extends from aperture 32 to aperture 33 in surface 17, which apertures are approximately 120 degrees of each other; bore 24 extends from aperture 34 to aperture 35 in surface 17, which are approximately 120 degrees from each other; and bore 25 extends from aperture 36 to aperture 37 in surface 17, which are approximately 120 degrees of each other. Thus, as can particularly be observed in the plan view, FIG. 2, bores 20, 21 and 22, and bores 23, 24 and 25 generally form an equilateral triangle and are thus at an angle of 60 degrees of each other.

Figure 6:
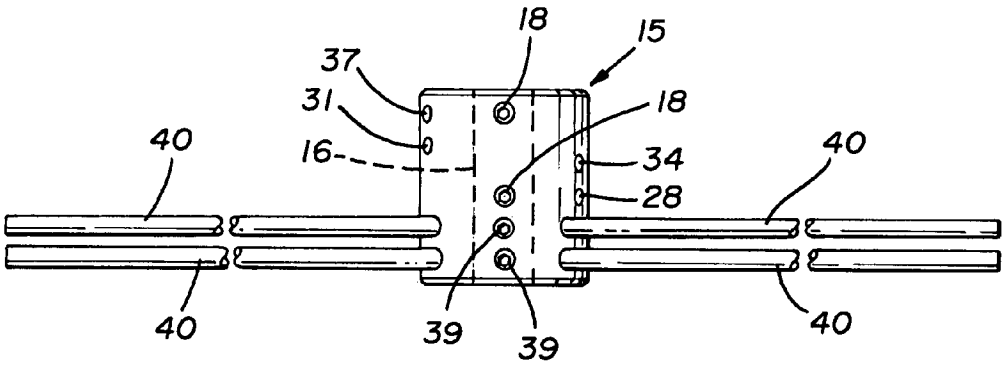
FIG. 6 is an elevational view similar to FIG. 3 but showing fragmented antenna rods mounted in the block in a centered condition.
Figure 7:
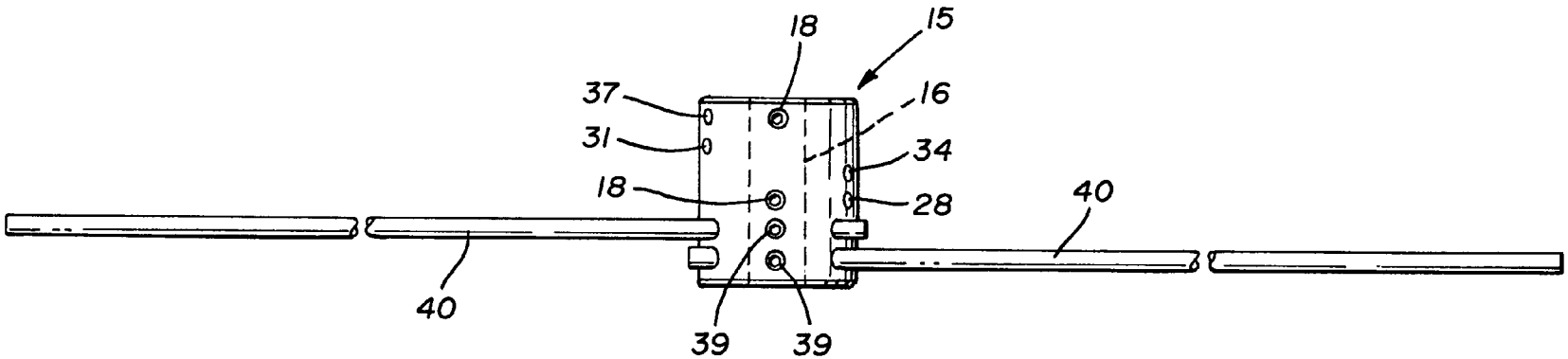
FIG. 7 is a view similar to FIG. 6 but showing the fragmented rods mounted in the block in a fully extended condition.

Each chordal bore 20–25 communicates with a generally radially extending passageway 38, each of which may selectively receive a set screw 39 to hold a conductive rod 40 as shown in FIGS. 6 and 7. Block 15 may hold a plurality of configurations of rods 40 dependent on the desired antenna parameters and performance, as now to be discussed.

When designing an antenna 10 in accordance with the present invention, the user has a wide variety of options. First, he may use as few as three rods 40 or as many as six rods 40. For example, if the three rod configuration were selected, rods 40 could be positioned in the first set of chordal bores 20, 21 and 22, or in the second set of chordal bores 23, 24 and 25. If six rods 40 are to be employed, all bores 20–25 would receive a rod 40. FIGS. 6 and 7 show how bores 20 and 23 might receive rods 40, it being understood that in a six rod configuration, the other bores shown in FIGS. 6 and 7 would also receive rods 40.

FIGS. 6 and 7 also depict another design option afforded by the present invention. That is, rods 40, whether in the three rod or six rod configuration, when positioned in any bore of block 15, can be centered where they extend outwardly in opposite directions an equal distance from block 15, as shown in FIG. 6; can be fully extended, where they each extend outwardly in one direction to their maximum extent, as shown in FIG. 7; or can be located somewhere between the centered position and the fully extended position. Thus, in the three or six rod centered configuration, all rods 40 extend outwardly an equal distance from block 15 in both directions from block 15 as shown in FIG. 6. However, in the three rod extended configuration, one rod 40 would fully extend out of bore 20 through aperture 27, for example; the second rod 40 would fully extend out of bore 21 through aperture 29, for example; and the third rod 40 would fully extend out of bore 22 through aperture 31, for example. In the six rod extended configuration, as partially shown in FIG. 7, the lowest rod 40 could fully extend out of bore 20 through aperture 27, for example, in which event the next adjacent rod 40 would fully extend out of bore 23 through aperture 32. Then another rod 40 would fully extend out of bore 21 through aperture 28, and its adjacent rod 40 would fully extend out of bore 24 through aperture 35. The fifth rod 40 would fully extend out of bore 22 through aperture 31, and its adjacent rod 40 would fully extend out of bore 25 through aperture 36.

Another design option for antenna 10 relates to the length of rods 40. While rods 40 could be provided in essentially any length, it has been found that by providing them in six inch, twelve inch, and twenty-four inch lengths, the resonant frequencies of mobile antenna 10 can be configured over a wide range. However, it may be possible to employ rods 40 of up to a length of seventy-two inches if there are no size constraints for the particular antenna 10.

Thus, by selecting the number of rods 40, the length of the rods 40, and whether they are centered or fully extended, an antenna 10 in accordance with the present invention can be uniquely designed to resonate at a desired frequency. Table I demonstrates how such design can be accomplished.

TABLE I

| CONFIGURATION | 10M | 11M | 12M | 15M | 17M | 20M | 30M |
|---|---|---|---|---|---|---|---|
| 3 - 6-in Rods Centered | 27.7 | 27.1 | 25.6 | 21.4 | 21.2 | 15.7 | 11.1 |
| 6 - 6-in Rods Centered | 27.0 | 26.4 | 25.0 | 21.0 | 20.7 | 15.3 | 10.9 |
| 3 - 6-in Rods Extended | 26.1 | 25.4 | 24.0 | 20.2 | 19.8 | 14.8 | 10.5 |
| 3 - 6-in Centered w/ 12-in Stinger | 23.6 | 23.8 | 21.7 | 18.0 | 17.9 | 13.3 | 9.7 |
| 6 - 6-in Rods Extended | 23.5 | 22.9 | 21.7 | 18.0 | 17.6 | 13.2 | 9.7 |
| 6 - 6-in Centered w/ 12-in Stinger | 23.3 | 22.7 | 21.4 | 17.8 | 17.6 | 13.2 | 9.6 |
| 3 - 12-in Rods Centered | 23.0 | 22.5 | 21.2 | 17.5 | 17.4 | 13.0 | 9.5 |
| 3 - 6-in Extended w/ 12-in Stinger | 22.6 | 22.1 | 20.9 | 17.3 | 17.0 | 12.8 | 9.4 |
| 6 - 12-in Rods Centered | 22.3 | 21.7 | 20.5 | 16.9 | 16.7 | 12.6 | 9.2 |
| 6 - 6-in Extended w/ 12-in Stinger | 21.2 | 20.6 | 19.4 | 16.1 | 15.8 | 12.0 | 8.8 |
| 3 - 12-in Rods Extended | 21.1 | 20.5 | 19.3 | 16.0 | 15.9 | 11.8 | 8.8 |
| 3 - 12-in Centered w/ 12-in Stinger | 21.0 | 20.3 | 19.1 | 15.9 | 15.6 | 11.8 | 8.7 |
| 6 - 12-in Centered w/ 12-in Stinger | 20.5 | 19.9 | 18.6 | 15.5 | 15.2 | 9.5 | 8.6 |
| 3 - 12-in Extended w/ 12-in Stinger | 19.4 | 18.7 | 17.6 | 14.8 | 14.5 | 10.8 | 8.2 |
| 6 - 12-in Rods Extended | 17.8 | 17.2 | 16.2 | 13.4 | 13.4 | 10.2 | 7.6 |
| 3 - 24-in Rods Centered | 17.2 | 17.2 | 16.0 | 13.8 | 13.2 | 10.0 | 7.5 |
| 6 - 12-in Extended w/ 12-in Stinger | 16.9 | 16.4 | 15.5 | 13.1 | 12.8 | 10.5 | 7.3 |
| 3 - 24-in Centered w/ 12-in Stinger | 16.7 | 16.4 | 15.3 | 13.1 | 12.9 | 9.6 | 7.1 |
| 6 - 24-in Rods Centered | 16.5 | 16.4 | 15.4 | 13.1 | 12.7 | 9.5 | 7.3 |
| 6- 24-in Centered w/ 12-in Stinger | 15.9 | 15.7 | 14.9 | 12.4 | 12.4 | 9.2 | 7.0 |
| 3 - 24-in Rods Extended | 15.9 | 15.3 | 14.7 | 12.2 | 12.2 | 9.0 | 6.7 |
| 3 - 24 in Extended w/ 12-in Stinger | 15.2 | 14.7 | 13.9 | 11.6 | 11.4 | 8.6 | 6.5 |
| 6 - 24-in Rods Extended | 13.1 | 12.5 | 11.8 | 10.0 | 9.9 | 7.3 | 5.7 |
| 6 - 24-in Extended w/ 12-in Stinger | 12.9 | 12.3 | 11.6 | 9.9 | 9.6 | 7.1 | 5.6 |
| 3 - 48-in Rods Centered | 13.0 | 12.4 | 11.8 | 10.0 | 9.6 | 7.4 | 5.6 |
| 6 - 48-in Rods Centered | 12.2 | 11.8 | 11.3 | 9.3 | 9.4 | 6.9 | 5.4 |
| 3 - 48-in Centered w/ 32-in Stinger | 12.0 | 11.6 | 10.9 | 9.1 | 9.0 | 6.9 | 5.3 |
| 3 - 48-in Rods Extended | 11.8 | 11.2 | 10.6 | 9.0 | 8.8 | 6.6 | 5.2 |
| 6 - 48-in Centered w/ 32-in Stinger | 11.6 | 11.1 | 10.5 | 8.9 | 8.8 | 5.0 | 5.0 |
| 3 - 48-in Extended w/ 32-in Stinger | 11.0 | 10.4 | 9.9 | 8.5 | 8.5 | 6.3 | 4.8 |
| 6 - 48-in Rods Extended | 9.0 | 8.7 | 8.7 | 6.8 | 6.7 | 5.1 | 4.0 |

TABLE I-continued

| CONFIGURATION | 10M | 11M | 12M | 15M | 17M | 20M | 30M |
|---|---|---|---|---|---|---|---|
| 6 - 48-in Extended w/ 32-in Stinger | 8.6 | 8.5 | 8.1 | 6.6 | 6.6 | 5.7 | 3.9 |

Table I depicts measurements taken when providing a mobile antenna sold under the trademark HUSTLER® and manufactured by New-Tronics Antenna Corporation of Mineral Wells, Tex., with arrays of rods 40 in accordance with the present invention. The left hand column describes the configuration of the rods, that is, the number of rods (three or six), the length of the rods (six, twelve, twenty-four or forty-eight inches), and whether the rods are centered or extended. Table I also shows the effect of adding an optional stinger to an antenna of the present invention.

The other remaining columns of Table I relate to the size of the coil 13 selected for antenna 10. Here, columns are provided for 10, 11, 12, 15, 17, 20 and 30 meter coils to be used with the HUSTLER® antenna. Or, if antenna 10 were of the screwdriver type, which is an antenna provided with a variable coil, these columns would depict the desired setting for that variable coil.

To select the appropriate rod configuration, the user first identifies the frequency at which he would like to operate. For purposes of this example, it will be assumed that it is desired to design an antenna 10 which will resonate at 9.0 MHz. Keeping in mind that it is desirable to use the smallest possible coil to keep losses at a minimum, one begins in the ten meter column and reads down until the desired frequency, or slightly lower, is reached. Referring to Table I, it can be determined that six, forty-eight inch extended rods will provide that frequency (9.0 MHz) with a ten meter coil. However, it is possible that the user may not have forty-eight inch rods available to him or that fully extended forty-eight inch rods would be size prohibitive. If so, the next column to the right in Table I may be referred to whereby one learns that even with an eleven meter coil, six, forty-eight inch fully extended rods would be required. In fact, Table I shows that to provide an antenna which resonates at 9.0 MHz with less than forty-eight inch rods, a twenty meter coil with three, twenty-four inch extended rods can be utilized, or a thirty meter coil with six, six inch fully extended rods with a twelve inch stinger could be utilized.

An antenna configured as described herein is also readily fine-tuned. For example, if one of the configurations selected with reference to Table I is not a configuration which give the user the exact frequency of interest, there are several manners in which the antenna 10 can be fine-tuned. For example, to lower the frequency, the rods 40 may be moved outwardly, and to raise the frequency, the rods 40 may be moved inwardly. Referring to Table I, for example, if the frequency of interest was 20.0 MHz and one was using a twelve meter coil with three, twelve inch rods centered, creating a resonant frequency of 21.2 MHz, one could move those rods outwardly until the frequency was lowered to 20.0 MHz.

Or the length of the rods could be altered to change the frequency. Thus, in the example just given, to lower the frequency from 21.2 MHz to 20.0 MHz, one could operate with rods slightly longer than twelve inches. Of course, to raise the frequency, shorter rods could be utilized.

Alternatively, the number of rods 40 could be increased to lower the frequency or decreased to raise the frequency. In these circumstances, care must be taken to maintain a balanced configuration as would be evident to one skilled in the art.

Finally, the frequency of a configured antenna 10 can always be fine-tuned by means of a stinger. That is, to lower the frequency, one may always add a stinger or add to the length of an existing stinger. Conversely, to raise the frequency, one can remove or shorten an existing stinger.

In view of the foregoing, it should be evident that an antenna constructed in accordance with the present invention and configured in accordance with the method of the present invention, accomplishes the objections of the invention, and otherwise significantly improves the antenna art.

What is claimed is:

1. An antenna comprising a conductive mast, a conductive block carried by the mast, a plurality of bores extending through the block, and conductive rods slidably received in at least some of said bores.

2. The antenna of claim 1 further comprising a passageway communicating with each said bore adapted to receive a set screw to hold said rods at a selected position within said bores.

3. The antenna of claim 1 wherein said block includes an additional bore to receive said mast and at least one passageway communicating with said additional bore adapted to receive a set screw to hold said block on said mast.

4. The antenna of claim 1 wherein said block is generally cylindrical.

5. The antenna of claim 4 wherein said bores extend generally chordally through said block.

6. An antenna of claim 5 wherein each said bore forms opposed apertures in said block, said apertures being approximately 120 degrees of each other.

7. The antenna of claim 4 wherein said block includes an axial bore to receive said mast.

8. The antenna of claim 1 further comprising a coil positioned on said mast.

9. The antenna of claim 1 wherein each said bore forms opposed apertures in said block and said rods extend out of said apertures approximately an equal distance from said block.

10. The antenna of claim 1 wherein each said bore forms opposed apertures in said block and said majority of the length of rods extend out of one of said apertures.

11. An antenna comprising a mast, a generally cylindrical block carried by said mast, said block having a first set of three axially spaced bores extending generally chordally through said block, and conductive rods slidably received in at least some of said bores.

12. The antenna of claim 11 wherein there is a second set of three axially spaced bores, said bores of said second set each being axially spaced from an adjacent bore of said first set of bores.

13. A method of constructing an antenna having a mast carrying a coil and a plurality of rods comprising the steps of identifying a desired frequency of operation for the antenna, selecting the size of the coil and the configuration of the rods which will provide approximately the desired frequency, and constructing the antenna with the selected coil and rod configuration.

14. The method of claim 13 wherein the step of selecting includes the step of identifying the rod configuration which will provide approximately the desired frequency using the smallest coil.

15. The method of claim 13 wherein the step of selecting includes the step of selecting the number of rods in the configuration of rods.

16. The method of claim 15 wherein three rods or six rods can be selected.

17. The method of claim 13 wherein the step of selecting includes the step of selecting the position of the rods relative to the mast.

18. The method of claim 13 wherein the step of selecting includes the step of selecting the length of the rods.

19. The method of claim 18 wherein the step of selecting includes the step of selecting the number of rods in the configuration of rods.

20. The method of claim 19 wherein the step of selecting includes the step of selecting the position of the rods relative to the mast.

21. The method of claim 13 further comprising the step of adjusting the frequency of the antenna.

22. The method of claim 21 wherein the step of adjusting includes the step of adding a stinger to the antenna.

23. The method of claim 21 wherein the step of adjusting includes moving the rods relative to the mast.

24. A method of constructing an antenna having a mast carrying a plurality of rods comprising the steps of selecting the number of rods, selecting the length of the rods, and determining the positioning of the rods relative to the mast.

25. The method of claim 24 wherein the selecting and determining steps are dictated by the desired frequency of operation.

26. The method of claim 25 further comprising the step of selecting a coil for the antenna based on selecting and determining steps.

27. The method of claim 24 further comprising the step of adjusting the frequency of the antenna.

28. The method of claim 27 wherein the step of adjusting includes the step of adding a stinger to the antenna.

29. The method of claim 28 wherein the step of adjusting includes moving the rods relative to the mast.

* * * * *